US012528003B2

(12) United States Patent
Chatis

(10) Patent No.: US 12,528,003 B2
(45) Date of Patent: Jan. 20, 2026

(54) PICKLEBALL TRAINING APPARATUS

(71) Applicant: Andrea Beth Chatis, Manchester, NH (US)

(72) Inventor: Andrea Beth Chatis, Manchester, NH (US)

( * ) Notice: Subject to any disclaimer, the term of this patent is extended or adjusted under 35 U.S.C. 154(b) by 279 days.

(21) Appl. No.: 18/234,963

(22) Filed: Aug. 17, 2023

(65) Prior Publication Data

US 2024/0058677 A1 Feb. 22, 2024

Related U.S. Application Data

(60) Provisional application No. 63/371,867, filed on Aug. 18, 2022.

(51) Int. Cl.

| | |
|---|---|
| ***A63B 69/36*** | (2006.01) |
| ***A63B 43/00*** | (2006.01) |
| ***A63B 60/46*** | (2015.01) |
| ***A63B 69/00*** | (2006.01) |
| *A63B 59/42* | (2015.01) |

(52) U.S. Cl.

CPC ..... *A63B 69/0091* (2013.01); *A63B 43/004* (2013.01); *A63B 60/46* (2015.10); *A63B 59/42* (2015.10); *A63B 2060/464* (2015.10); *A63B 2220/35* (2013.01); *A63B 2225/093* (2013.01)

(58) Field of Classification Search

CPC ... A63B 69/0091; A63B 43/004; A63B 60/46; A63B 59/42; A63B 2060/464; A63B 2220/35; A63B 2225/093; A63B 2102/08; A63B 2220/30; A63B 2220/833; A63B 2225/09; A63B 2225/50

USPC ..... 473/416, 419, 420, 423, 427, 429, 446

See application file for complete search history.

(56) References Cited

U.S. PATENT DOCUMENTS

| | | | | |
|---|---|---|---|---|
| 2,823,038 | A * | 2/1958 | White | A63B 69/0091 473/149 |
| 4,105,203 | A * | 8/1978 | Cho | A63B 69/0091 473/429 |
| 4,561,661 | A * | 12/1985 | Walker | A63B 69/0091 473/423 |
| 5,480,141 | A * | 1/1996 | Wood | A63B 69/0079 473/145 |
| 5,531,438 | A | 7/1996 | Corley | |
| 7,811,183 | B1 * | 10/2010 | Ohle | A63B 69/002 473/429 |
| 8,128,516 | B2 * | 3/2012 | Pan | A63B 69/0091 473/422 |
| 10,729,961 | B2 * | 8/2020 | Ohle | A63B 69/002 |

(Continued)

*Primary Examiner* — Nini F Legesse

(74) *Attorney, Agent, or Firm* — The Dobrusin Law Firm, P.C.; Alexandria J. Janda

(57) ABSTRACT

A pickleball training apparatus that includes a base; a substantially vertical stem configured to engage the base; and an arm assembly coupled to the vertical stem, the arm assembly having: a) a coupler having: i) a bearing configured to engage the vertical stem; ii) one or more apertures; and iii) one or more stand offs; b) one or more arms each having a proximal end configured to engage the one or more apertures of the coupling; and c) a ball connected to a distal end of each of the one or more arms; the one or more arms are substantially rigid and extend in a substantially horizontal orientation from the coupler and the substantially vertical base; and the one or more stand offs extend from the coupler in a generally vertical orientation.

15 Claims, 8 Drawing Sheets

(56) References Cited

U.S. PATENT DOCUMENTS

| | | | | |
|---|---|---|---|---|
| 11,376,483 | B1 | 7/2022 | Prewitt | |
| 2010/0304900 | A1* | 12/2010 | Gu | A63B 69/0075 473/419 |

* cited by examiner

PICKLEBALL TRAINING APPARATUS

CROSS REFERENCE TO RELATED APPLICATIONS

This application claims priority to U.S. 63/371,867 filed Aug. 18, 2022, the entirety of which is hereby incorporated by reference herein for all purposes.

FIELD

These teachings relate to a game or training apparatus, and more particularly to an apparatus for a player to strike a pickleball with a paddle.

BACKGROUND

The ability for a player to accurately contact a ball with a paddle is a fundamental skill needed for racquet sports. While various training devices have been made available for players to practice this skill, improvement in the art may be desired. It may be especially desirable to provide a training device for pickleball, allowing players of all ages to practice on and play on their own.

SUMMARY

These teachings provide a training device or apparatus that allows a player to practice and improve hand/eye coordination, reaction time, and/or to train with or without a partner or coach. This apparatus may be suitable for all ages, due to its construction, portability, and adjustability. While this application directs the apparatus for use with a pickleball game, this device may also find use in other sports, such as tennis, ping pong, baseball, squash, racquetball, etc.

The apparatus according to these teachings includes a ball attached to a generally rigid arm that is configured to swivel or rotate about a stem or pole. A user can hit the ball with a forehand stroke causing the ball and arm to rotate about the stem or pole in one direction and then strike the ball with a backhand stroke to cause the ball and arm to rotate about the stem or pole in the opposite direction. This advantageously allows a player to work on both strokes while also working to improve their coordination and reaction time to strike the ball.

In some configurations, two players can stand on either side of the device and hit the ball back and forth. The height of the arm on the stem is adjustable, thereby allowing players of various height and ages to use the apparatus. Moreover, the ability to move the ball and arm up and down along a length of the stem or pole allows a player to train low shots, midlevel or waist shots, and high shots.

In some configurations, the speed that the ball and arm rotate about the stem or pole can be adjusted. For example, the amount of friction acting on the arm and stem may be increased to slow the rotation of the arm about the stem which may advantageously allow a player to strike the ball with high speeds and still catch the ball on the opposite side with a backhand shot. In other configurations, the amount of friction may be reduced between the arm and the stem so that the speed at which the arm and ball rotate about the stem or pole is increased, which may thereby allow a user to practice their reaction time.

In some configurations, the angle at which the ball is presented to the player may be adjusted by manipulating the one or more couplers on the apparatus. In some configurations, more than one pickleball and/or arm assembly may be attached to the stem, thereby allowing more than one player to use the apparatus and/or allow one player to hit multiple pickleballs, which may be advantageous to improve hand eye coordination and reaction time.

These teachings may find use for individual training at home, in parks, at schools and training facilities, occupational health centers, physical therapy and rehab training, etc. This apparatus may advantageously improve a player's reaction time, teach proper hitting and strike patterns, teach proper footwork and stance, provide a core workout, and/or improve hand eye coordination.

DETAILED DESCRIPTION

Figure 1:
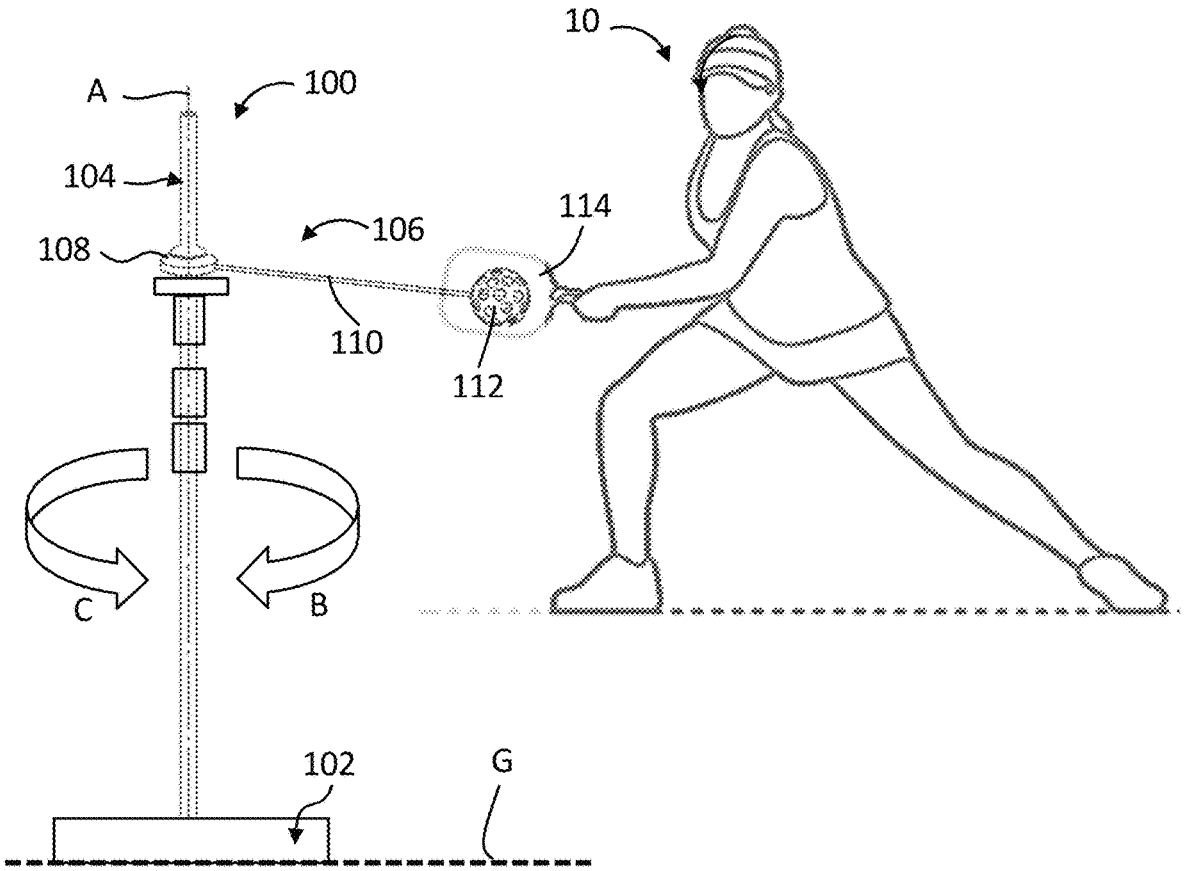
FIG. 1 illustrates a player using the apparatus according to these teachings.

FIG. 1 illustrates a player 10 using the apparatus 100 according to these teachings. The apparatus 100 generally comprises a base 102, a stem 104 configured to engage the base 102, and an arm assembly 106 coupled to the stem 104. The stem 104 may be substantially linear and extend along an axis A that is substantially vertical or perpendicular to the base 102 and/or the ground G.

Various bases, stems, and arm assemblies are disclosed herein. It is within the scope of this disclosure that an apparatus may be construed by mixing and matching elements from one or more of the bases, stems, and/or arm assemblies disclosed herein. In the interest of brevity, all combinations are not disclosed herein, however, all combinations are envisioned and therefore incorporated into this disclosure. A non-limiting example of this is the arm assembly 106' of FIG. 10 may be added to the apparatus 100 of FIG. 6A, and/or may be used with the stem 104' in FIG. 13.

The arm assembly 106, which is described in greater detailed below and with reference to other Figures, generally comprises a coupler 108 configured to engage the stem 104, one or more arms 110 that engage the coupler 108, and one or more balls 112 connected to the one or more arms 110. The coupler 108 is configured to rotate or spin about a longitudinal axis A of the stem 104, which therefore provides for the corresponding arm 100 and ball 112 to rotate or spin about the axis A.

During use, the player 10 may hit the ball 112 with a paddle 114, thereby causing the arm assembly 106 to rotate or spin about or around the stem 104 or the longitudinal axis A thereof. The player 10 may hit the ball with a backhand shot, which may cause the arm assembly 106 to rotate about the stem 104 in a first direction B and/or with a forehand shot, which may cause the arm assembly to rotate about the stem 104 in a first direction C. Advantageously, the player 10 may hit a backhand and forehand shot without the arm assembly 106 rotating completely around the stem 104. Alternatively, the player may hit only forehand shots, or only backhand shots, or mix and match both forehand and backhand shots to further develop and refine hitting techniques, reaction time, paddle position, footwork, etc.

Figure 2:
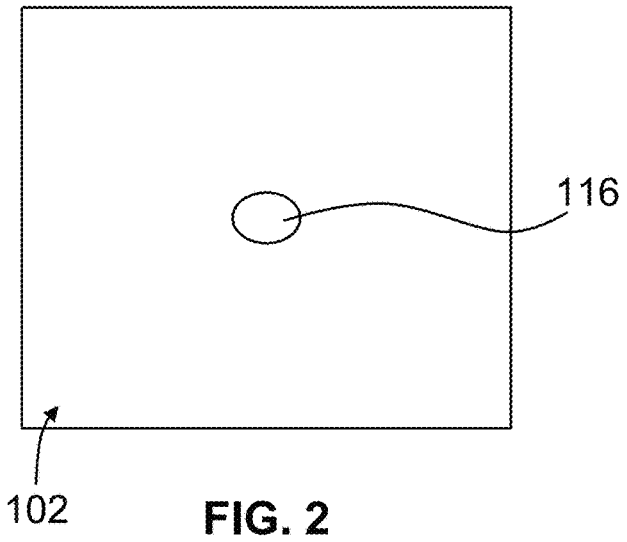
FIG. 2 is a top view of the base of the apparatus.
Figure 12:
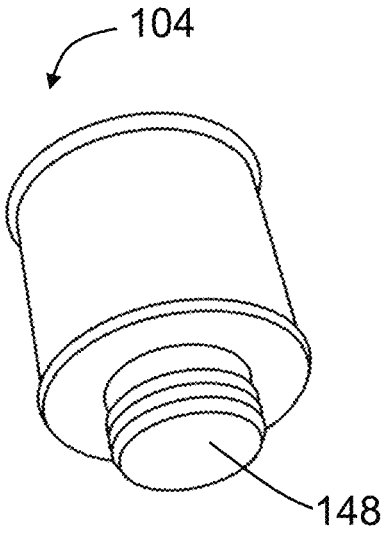
FIG. 12 is a perspective view of the attachment of the stem.

FIG. 2 illustrates the base 102. The base 102 may comprise one or more apertures 116 that may function to receive or engage a portion of the stem 104. The engagement between the stem 104 and the base/aperture 102/116 may be a threaded connection such that the stem 104 engages the base 102 by threading the stem 104 into the aperture 116. This means that the proximal end of the stem 104 may include a threaded part 148, which is illustrated in FIG. 12. Therefore, the aperture 116 may include internal threads that are configured to engage the threads on the threaded part 148 in FIG. 12. Of course, in some configurations, the threaded aperture 116 may be replaced with the threaded part 148 in FIG. 12 and the threaded part 148 in FIG. 12 may be replaced with the threaded aperture 116 in FIG. 2 and still function in the same manner. Alternatively, the engagement between the stem 104 and the base/aperture 102/116 may be a press fit, friction fit connection, or magnetic connection, and/or may include one or more locking pins, or other fasteners for maintaining the connection therebetween. In some configurations, the connection between the stem 104 and the base 102 may be permanent, which may mean that the two components cannot be separated without damaging one or both of the base 102 and the stem 104. Preferably, the stem 104 and the base 102 can be separated without damaging either the base 102 or the stem 104 to provide modularity and to easily transport the apparatus 100 or allow the apparatus 100 to fit within a carrying case or bag.

Figure 11:
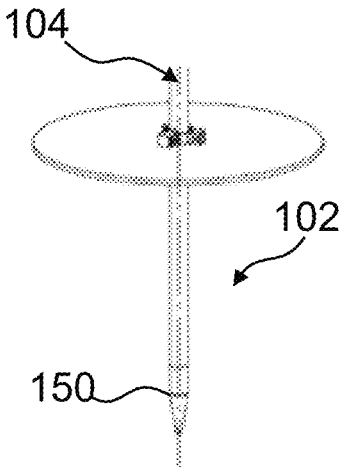
FIG. 11 is a perspective view of a portion of the stem and the base of the apparatus.

The base 102 may be made of a suitable material such as plastic, metal, a composite, 3D printed, or a combination thereof. The base 102 may be sufficiently heavy on its own to withstand a player hitting the ball and causing the arm assembly 106 to move. In some configurations, the base 102 may be filled with a substance such as water, sand, rocks, cement, etc. to give additional weight to the base 102. In some configurations, the base 102 may include one or more spikes, stakes or other structures that may be inserted into the grass or ground to stabilize the base and apparatus. This is illustrated in FIG. 11, where the distal end of the stem 104 includes a spike or chamfered part 150 that may be configured to be inserted into or pounded into the ground for play on the grass for example. In other configurations, the base 102 may include one or more rollers, wheels, casters, etc. that may allow the base 102 to slide or be easily moved on the ground for ease of transport and then locked to prevent rolling.

The base 102 may function to provide structure and/or stability for the apparatus 100. The base 102 may function to absorb vibrations during use of the apparatus 100, so that the apparatus does not tip or fall over when the ball is hit by the paddle.

In some configurations, the base 102 may be large enough to attach more than one stem 104 so that multiple players can use the apparatus at once, but with individual stems and arm assemblies connected thereto. This may be advantageous for parks, schools, or training centers, where more than one player is present to play.

Figure 3:
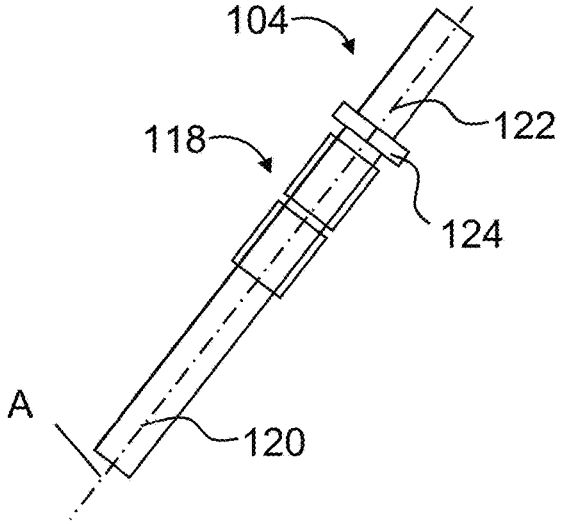
FIG. 3 is a perspective view of the stem of the apparatus.

FIG. 3 illustrates the stem 104. The step 104 may be an elongated member that extends along a longitudinal axis A. The stem 104 may have a single, fixed length. Alternatively, the length of the stem 104 may be adjustable along the longitudinal axis A. To this extent, the stem 104 may include one or more adjusters 118 that may function to extend or reduce the length of the stem 104. An adjustable length stem 104 may be advantageous to accommodate players of various sizes (i.e., tall, short, adult, child, etc.) and/or to adjust a position of the ball 112 relative to the player 10 to play or practice various shots and hits. The adjuster 118 may be a set screw that allows a first shaft of part 120 and second shaft or part 122 to move relative to one another (i.e., telescope) in order to increase or decrease a size or length of the stem 104. If there is more than one adjuster 118, then there could also be a third shaft or part, a fourth shaft or part, etc., which may allow for virtually any height of the stem. Of course, it may be desired that the stem 104 have markings and be configured to place the ball 112 at heights a player 10 would see or be exposed to during a pickleball match relative to the net on the court, which may be about 34 inches to 36 inches above the ground.

The stem 104 may be made of a suitable material, such as a plastic, composite, metal, 3D printed, wood, etc. material. The stem 104 may also be referred to as a pole, stick, or other elongated member. The stem 104 may be sufficiently rigid and may restrict bending to thereby provide a sufficient support for the one or more arm assemblies 106 attached thereto. The stem 104 may be sufficiently rigid to withstand unintentional hits by the player 10 during use. However, the stem 104 is also preferably forging to not damage a paddle 114 if inadvertently hit by the player 10.

The stem 104 may include a support 124. The support 124 may be a plate, base, or bearing that is along a length of the stem 104. The support 124 may be configured to support the one or more arm assemblies 106 in one or more locations along a length of axis A of the stem 104. The support 124 may be fixed to the stem 104, or the support 124 may be moveable along a length of the stem 104 to allow a user or player to adjust a height of the arm assemblies 106 along a length of the stem 104. This height adjustment may be advantageous to follow players of various heights and ages to use the apparatus 100, and or to allow a player to work on different shots. The support 124 may be made of the same material as the stem 102, the base 102, or may be made from a different material than those components.

Figure 4:
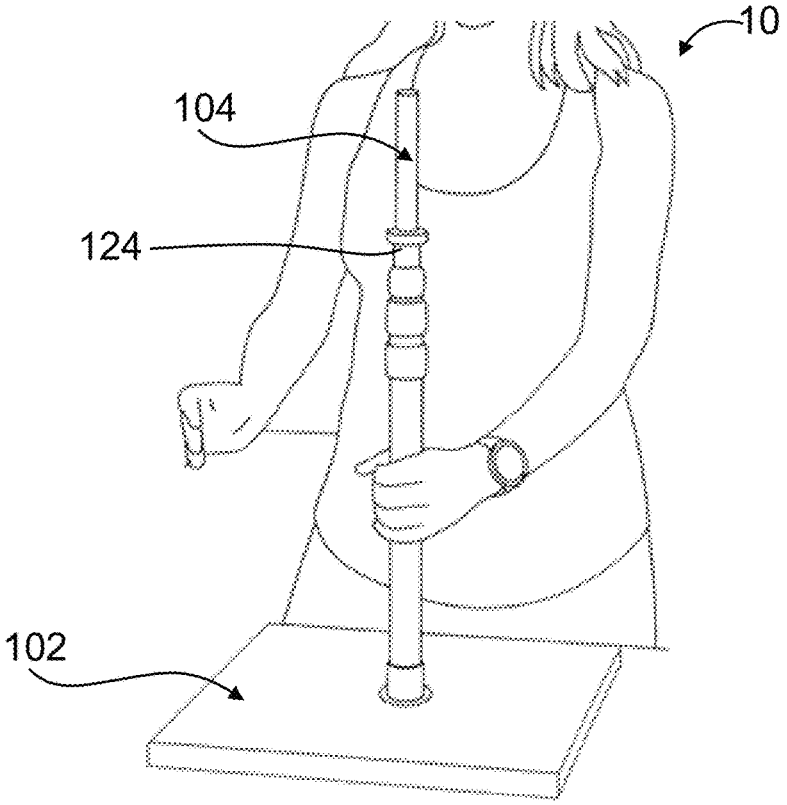
FIG. 4 is a perspective view of the stem and the base of the apparatus being assembled by a player.

FIG. 4 illustrates the stem 104 engaged with or assembled to the base 102. In this embodiment, a user or player 10 may align the stem 104 with the base so that the stem 104 engages the base 102. In this example, the threaded part 148 (FIG. 12) is configured to engage the threaded aperture 116 in the base 102. However, other methods of attaching the stem 104 to the base 102 are envisioned. In this assembled configuration, the stem 104 extends substantially vertically to the base 102 and the ground.

Figure 5A:
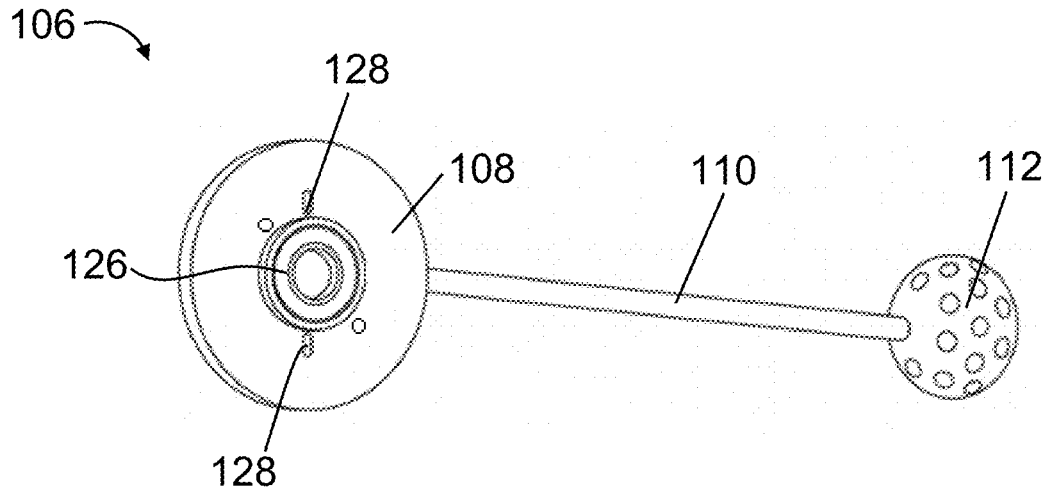
FIG. 5A is a perspective view of the arm assembly of the apparatus
Figure 5B:
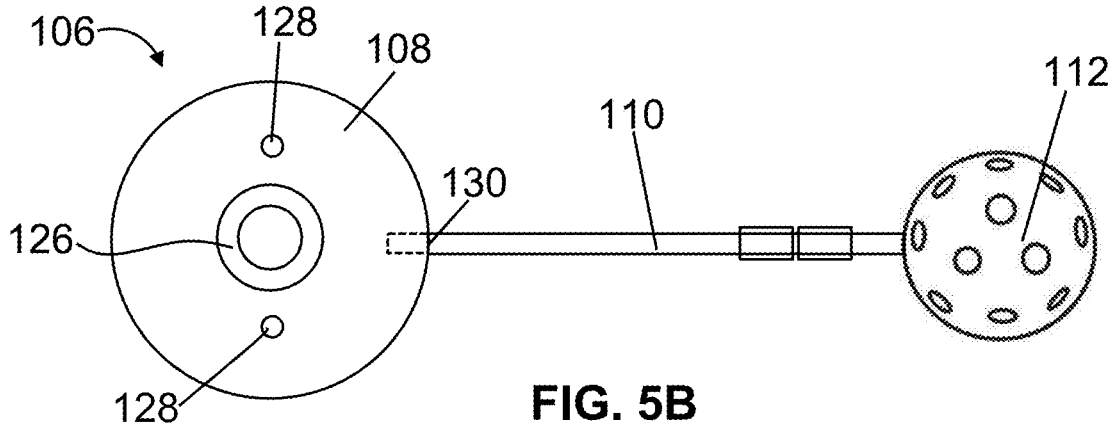
FIG. 5B is a top view of the arm assembly of the apparatus.
Figure 5C:
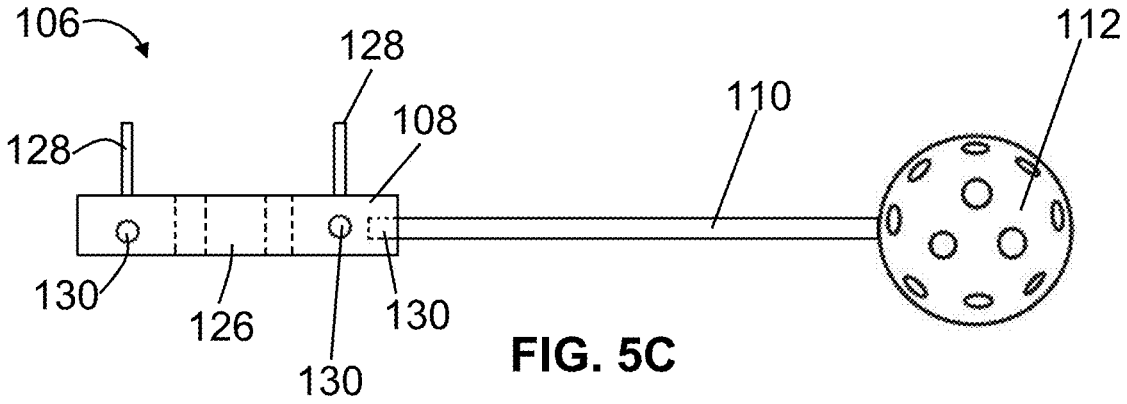
FIG. 5C is a side view of the arm assembly of the apparatus.

FIGS. 5A, 5B, 5C each illustrate an arm assembly 106. The arm assembly 106 generally comprises a coupler 108, one or more arms 110 that engage the coupler 108, and one or more balls 112 connected to the one or more arms 110. The apparatus 100 main include only one arm assembly 106. In some configurations, the apparatus 100 may include more than one arm assembly 106. Accordingly, should the apparatus 100 include more than one arm assembly 106, then all the assemblies 104 may be the same, or one or more of the arm assemblies 106 may be different than other arm assemblies 104. In this regard, structure of the arm assembly 106 disclosed may be the same for all arm assemblies 104 or one or more of the arm assemblies 106 may be different. A nonlimiting example of this is that one or more of the arm assemblies 106 may include one or more standoffs 128, described further below, while other arm assemblies 104 do not include any standoffs 128.

The coupler 108 may include a bearing 126. The bearing 126 may be centrally located relative to the coupler 108. The bearing 126 may be configured to engage the stem 104 of the apparatus 100 so that the arm assembly 106 can rotate or spin about the stem 104 and/or axis A. In some configurations, the bearing 126 may be omitted and the coupler 108 may instead just include an aperture that engages the stem 104. In some configurations, the coupler 108 may spin on the support 124. In some configurations, a friction adding member may be added to the bearing or in place of the bearing. The friction adding member may function to add friction to slow the speed that the arm assembly 106 rotates about the stem 104 after a user strikes the ball 112. In other configurations, the address 100 may include a friction reducing member which may allow the speed of the arm assembly 106 to travel faster about the stem. Accordingly, it is within the scope of this disclosure that the apparatus 100 includes adjustable friction member so that a user may set the speed that the arm 106 rotates or pivots about the stem 102 at their desired speed. The adjustable friction member may be or may include various bearings 126 that connect all the arm assembly 106 to the stem 104; Various weights that are attached or connected to the one arm assembly 106, various materials that are added or removed from the interface between the coupler 108 and or the bearing 126 and the stem 104.

The coupler 108 may include one or more stand-offs 128. The one or more stand-offs 128 may extend from the coupler 108 in a generally vertical orientation relative to the stem 104 in an assembled configuration. The one or more standoffs 128 may function to contact or engage another coupler 108 when more than one arm assembly 106 is attached to the stem 104 (See e.g., FIGS. 6A-6C). The one or more standoffs 128 may be one or more pins, screws, bolts, spacers, washers, fingers, pegs, etc.

The coupler 106 may include one or more apertures 130. The one or more apertures 130 may engage or may be engaged by a proximal end of the one or more arms 110 so that the one or more arms 110 extend in a substantially horizontal direction when the apparatus 100 in an assembled/use configuration (FIG. 1, 6A, 6C). A distal end of the one or more arms 110 may engage or may be engaged by a ball 112. The one or more apertures 130 may extend in a generally perpendicular direction relative to the bearing 126. The one or more apertures 130 may be threaded, press fit, include one or more magnets, or other quick connect features for engaging the one or more arms 110. For example, spring loaded pins, magnets, locking rings are envisioned.

The one or more arms 110 may be made of sufficiently rigid material, such as plastic, composite, 3D print, fiberglass, etc. The one or more arms 110 may restrict bending or compression. The one or more arms 110 may be sufficiently rigid to withdrawn unintentional hits with the paddle 114; however, may be sufficiently forging so as to not damage a paddle 114 if hit by the user 10.

Figure 6A:
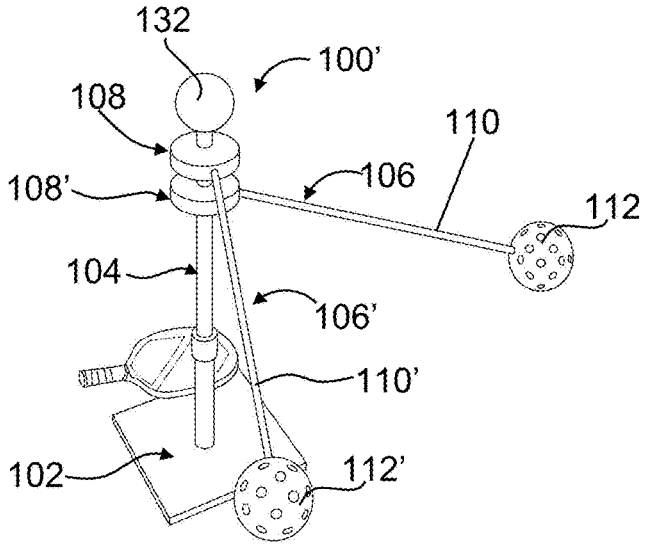
FIG. 6A is a perspective view of the apparatus according to these teachings.
Figure 6B:
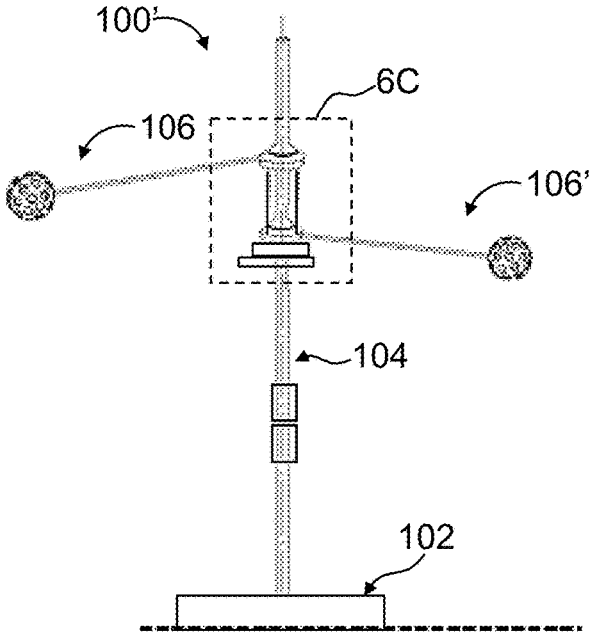
FIG. 6B is a side view of the apparatus according to these teachings.
Figure 6C:
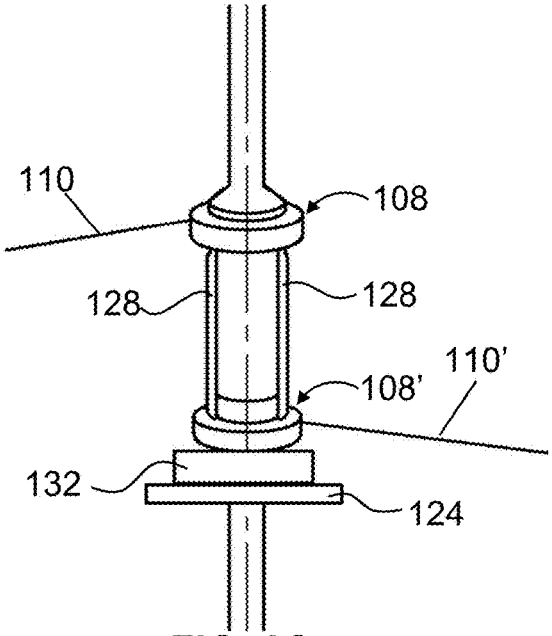
FIG. 6C is a detailed perspective view of a portion of FIG. 6B.

FIGS. 6A, 6B, 6C illustrate the apparatus 100'. The apparatus 100' in FIGS. 6A, 6B, 6C is substantially the same as the apparatus 100 discussed above in the previous figures; however, the apparatus 100' includes a second arm assembly 106'. The second arm assembly 106' may be substantially the same in structure and function as the arm assembly 106 (which may also be referred to as a first arm assembly). The coupler 108 of the first arm assembly 106 is separated from the coupler 108' of the second arm assembly 106' by way of the one or more stand offs 128. The one or more standoffs 128 may extend from the first coupler 106, the second coupler 106' or both couplers 106, 106'. In this regard, a vertical spacing between the couplers 106, 106' and therefore the corresponding balls 112, 112' may be set via the height or length one or more standoffs 128. The one or more standoffs 128 may be adjustable in height so that the corresponding height between the couplers 108, 108' and therefore the balls 112, 112' may be adjusted to accommodate players of various sizes and skill levels. The one or more standoffs 128 may function to prevent the two arm assemblies 106, 106' from colliding with one another. Or length of the one or more standoffs 128 may be adjustable in order to change the gapping or spacing in a vertical direction between the two balls 112, 112'.

With reference to FIG. 6C, the apparatus 100 may also include a grommet or bearing 132 that is located at or on the support 124. This grommet or bearing 132 may function to allow the arm assembly 108 or 108' to spin freely about the stem 104. The grommet or bearing 132 may be in addition or in place of the bearing 126 in the coupler 108 discussed above.

Figure 7A:
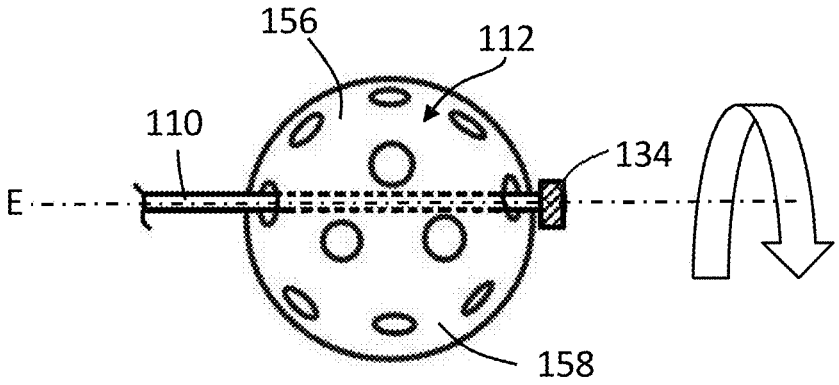
FIG. 7A is a side view of the ball and a portion of the arm.

FIG. 7A illustrates the distal end of the arm 110 passing all the way through and being engaged by a fastener 134 to connect the ball 112 to the arm 110. The ball 112 may be dived into two or more sections 156 and 158. Each of the sections 156, 158 may have a different color or pattern relative to each other. The two sections 156, 158 may be divided or split in a region where the arm one time extends therethrough. This may be especially advantageous if the Pickleball 112 is configured to spin about the arm 110 and or its longitudinal axis E so that a player 10 can see the ball properly spinning if a player is working on top spin shots for example. Of course in other configurations, the ball 112 may be restricted or prevented from spinning about the arm 110 and or axis E. The fastener 134 may be a bearing that may assist with the ball spinning about the axis E.

Figure 7B:
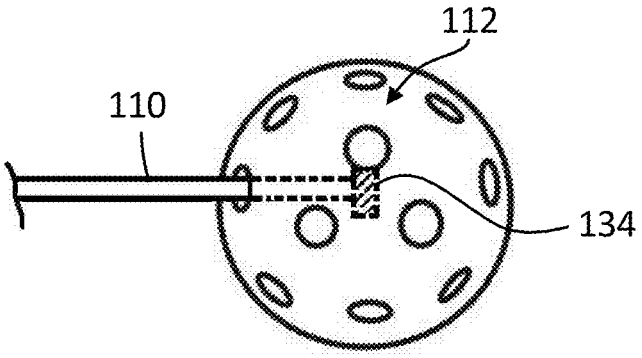
FIG. 7B is a side view of the ball and a portion of the arm.

In FIG. 7B, the distal end of the arm 110 is located within the ball 112 and the fastener 134 is located within the ball 112. This may be advantageous in order to prevent the paddle from contacting the distal end of the arm 110 and/or fastener 134.

Figure 8:
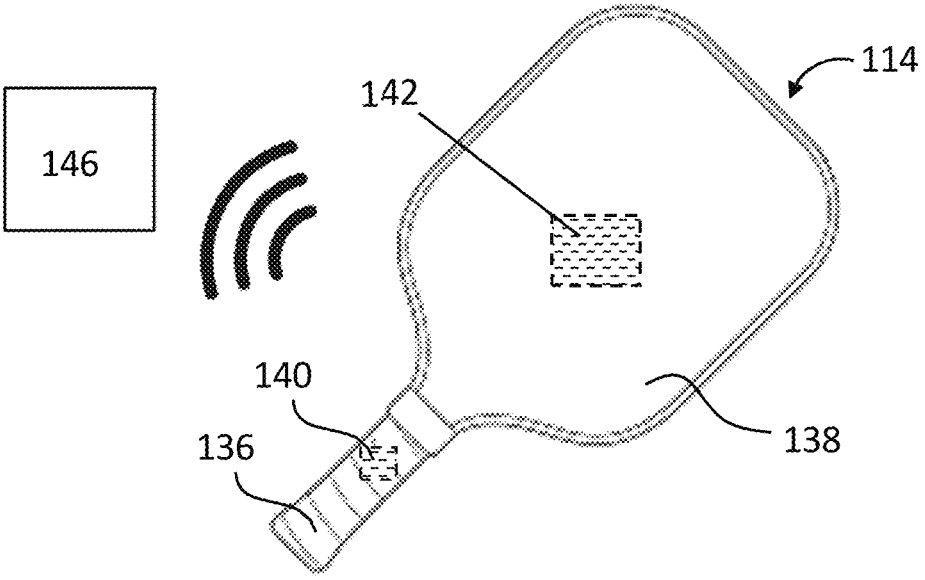
FIG. 8 is a perspective view of a paddle for use with the apparatus.

FIG. 8 illustrates a paddle 114. The paddle 114 may include a gripping or holding portion 136 and a paddle portion 138. The gripping or holding portion 136 may be gripped or held by the player and the paddle portion 138 may be used to hit the ball 112. The gripping or holding portion 136 may include one or more sensors or transmitters 140.

The one or more sensors or transmitters 140 may function to collect or analyze data such as the grip strength, grip position, swing speed, swing direction or path. In this regard, data may be collected, analyzed, and/or transmitted to one or more receivers 146. The one or more receivers 146 may analysis the data to determine the players grip position, grip strength, etc. The receiver 146 may provide feedback to the user or player to change or modify the grip if necessary Or to inform the player that their grip position and their strength is acceptable. In other configurations, the data may be sent to an instructor who might interpret the data and then provide instructions to the player to improve their hand and or grip strength and position.

Additionally, or alternatively, the paddle portion 138 may include one or more sensors and/or transmitters 142. The one or more sensors or transmitters 142 may function to collect or analyze data such the speed, position, intensity, orientation, that a player strikes the ball 112. In this regard, data may be collected, analyzed, and/or transmitted to one or more receivers 146. The one or more receivers 146 may analysis the data to determine the players paddle position, amount of spin placed on the ball, contact location of the ball on paddle, et. The receiver 146 may provide feedback to the user or player to change or modify the paddle position if necessary.

Figure 9:
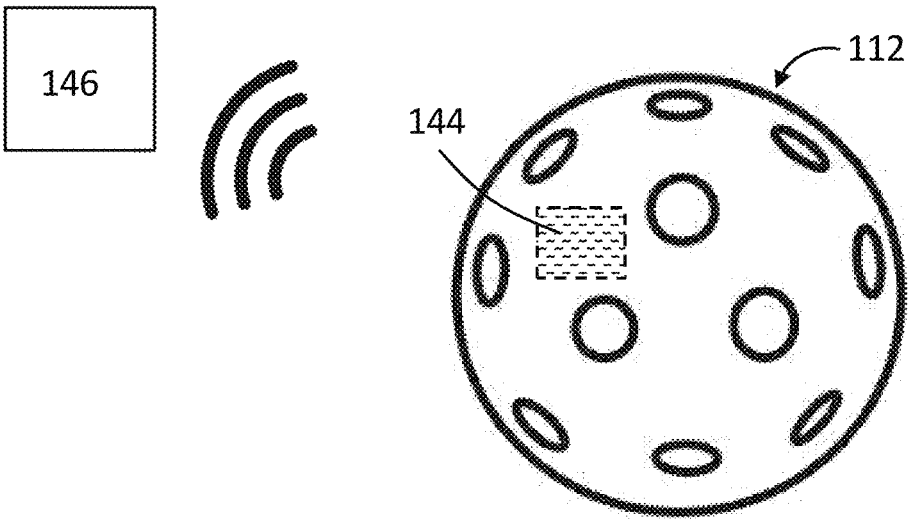
FIG. 9 is a side view of a pickleball for use with the apparatus.

FIG. 9 illustrates the ball 112. The ball may include one or more one or more sensors or transmitters 144. The one or more sensors or transmitters 144 may function to collect or analyze data such the speed, velocity, spin, position, intensity, orientation, that a player strikes the ball 112. sensor that is configured to record data concerning a speed, velocity, and spin of the ball. In this regard, data may be collected, analyzed, and/or transmitted to one or more receivers 146. The one or more receivers 146 may analysis the data to determine the players paddle position. The receiver 146 may provide feedback to the user or player to change or modify the paddle position if necessary.

The one or more sensors 140, 142, 144 may be one or more accelerometers, strain gauges, GPS, position sensors, gyroscopes, etc. The one or more receivers 146 may be a computer, a processor, a mobile device or phone, tablet, etc. The collected data may be instantaneously transmitted to a computer or processor. In other configurations the data collected may be stored in a memory located on the paddle 114, the ball 112, or both. The data may be sent into the cloud for storage and/or further processing. The data may be collected and sent to a mobile device such as a computer, cell phone, or tablet, for processing using the processor of the mobile device. In one or more configurations, the data may be translated to a mobile phone and or app running on the mobile phone. The app may function to store data and allow a user to track their progress on the apparatus 100.

Figure 10:
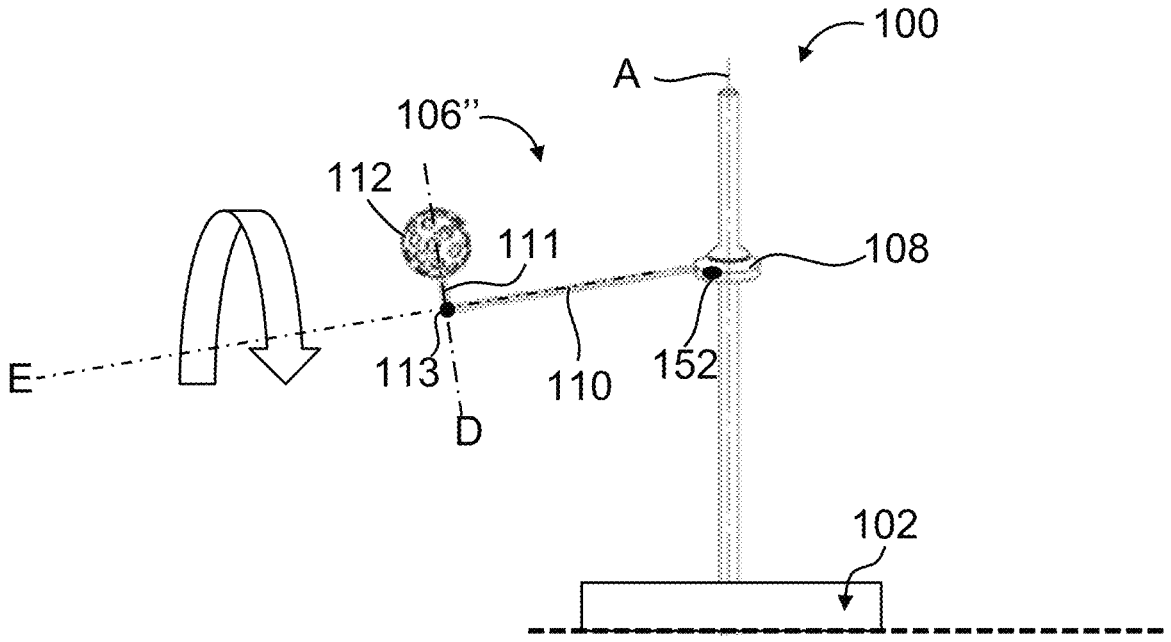
FIG. 10 is a side view of the apparatus according to these teachings.

FIG. 10 illustrates an apparatus 100. The apparatus 100 may be substantially similar to the other apparatuses illustrated and described herein. Therefore, only the different structures will be described. In particular, the arm assembly 106" comprises a second arm 111 and a second coupler 113 for connecting the second arm 111 to a distal end of the arm 110 or first arm 110. The second arm 111 may be substantially similar in structure, function, materials, etc. to the first arm 110 except the second arm 111 extends along an axis D that is different than the axis A of the stem 104. The axis D of the second arm 111 may be generally parallel to the stem 104 and/or perpendicular to the first arm 110 or may be arranged at a different angle or axis. The arm 111 may be configured to rotate about axis E of the first arm 110 via the coupler 113. The coupler 113 may be a swivel, hinge, bearing, etc. This arrangement of the ball 112 attached to the second arm 111 may allow for a player 10 to hit the ball 112 using top spin techniques. In some configurations, the ball 112 may also be configured to rotate or spin about the arm 111 or axis E, similar to what was in FIG. 7A, where there ball 112 can spin about the axis of the arm.

The ball 112 may be a split ball, meaning the ball 112 may be split along an imaginary hemispherical line or axis. The ball 112 may have two different colors at this hemispherical axis, to visually show the player 10 or coach the top spin being placed on the ball 112 by the player, similar to what was described at FIG. 7A.

The second arm 106" may be concerted to the stem 104 via coupler 108, like the one described previously. The coupler 108 may include an optional locking mechanism 152. The locking mechanism 152 may function to lock the coupler 108 to the stem 104 to restrict or prevent rotation of the arm assembly 106" about the stem 104 or axis A. This may be advantageous when a player is using the arm assembly 106" to practice top spin hits. However, in other configurations, the locking mechanism 152 may be unlocked to allow the arm assembly 106" to rotate about axis A and E after hitting the ball 112. This may be desired by advanced players.

Figure 13:
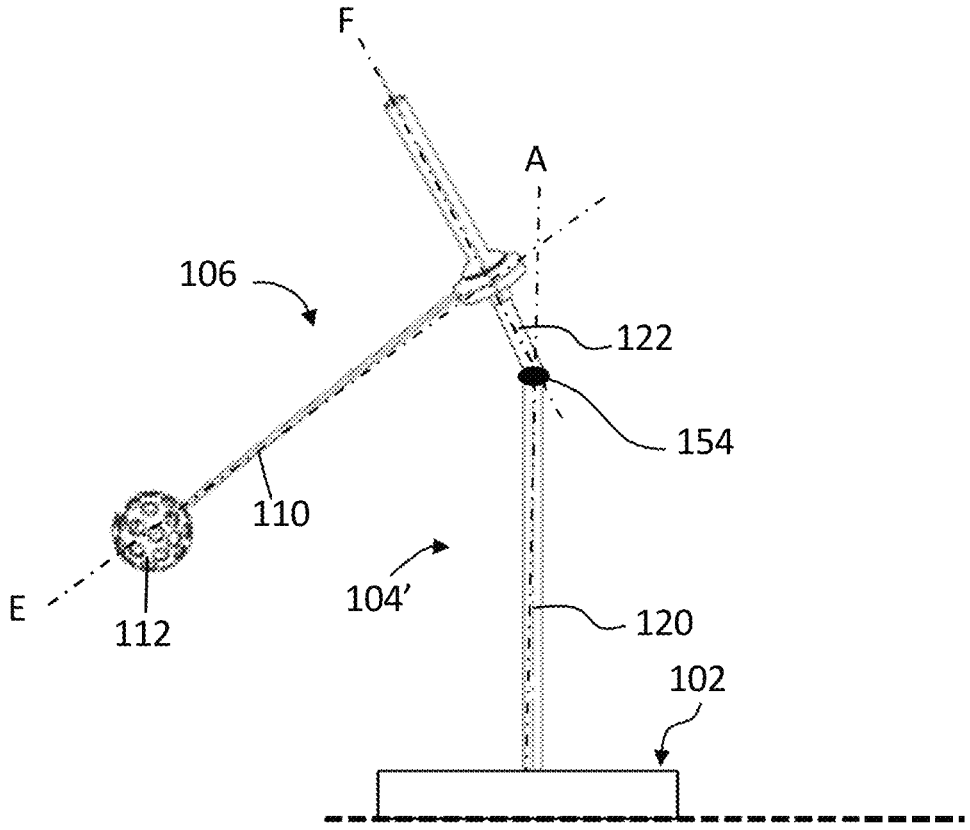
FIG. 13 is a side view of the apparatus according to these teachings.

FIG. 13 illustrates an apparatus 100. The apparatus 100 may be substantially similar to the other apparatuses illustrated and described herein. Therefore, only the different structures will be described. In particular, the stem 104' includes a first stem part 120, a second stem part 122, and a coupler 154 connecting the two stem parts 120, 122 together. The coupler 154 may function to allow the two stem parts 120, 122 to move along the same axis (i.e., telescope) to increase or decrease a height or length of the stem 104 as described above in FIG. 3. The coupler 154 may however, instead or in addition, allow the two stem parts 120, 122 to be moved so that the stem parts 120, 122 are in a different plane relative to one another and/or their individual axis are no longer aligned. For example, the coupler 154 may be a type of knee joint that provides for the axis F of the second part 122 to be arranged at an angle relative to axis A of the first part 120. Accordingly, such adjustments may be provided for the axis E of the arm 110 to not be substantially horizontal to the ground or perpendicular to the stem axis A. The angle of the arm 110 relative to the stem 104 or first stem part 120 may be any angle between 0 and 90 degrees. Of course, while the arm 110 is shown picoted to form an acute angle with the stem 104, the coupler 154 may provide for the arm 110 to move or pivot to form an obtuse angle with the stem 104 or axis A. Of course, the arm assembly 106 illustrated in FIG. 13 may be replaced with any of the arm assemblies illustrated and/or described herein.

These teachings also provide a method of assembling an apparatus, a method of using an apparatus, a method of disassembling an apparatus, or combination thereof. These teeth chains further provide a method of using an app or technology to assist a user or player in developing and improving their hitting in reaction time performance.

It is understood that the following method steps can be performed in virtually any order. Moreover, one or more of the following method steps can be combined with other steps; can be omitted or eliminated; can be repeated; and/or can separated into individual or additional steps.

The explanations and illustrations presented herein are intended to acquaint others skilled in the art with the invention, its principles, and its practical application. The above description is intended to be illustrative and not restrictive. Those skilled in the art may adapt and apply the invention in its numerous forms, as may be best suited to the requirements of a particular use.

Accordingly, the specific embodiments of the present invention as set forth are not intended as being exhaustive or limiting of the teachings. The scope of the teachings should, therefore, be determined not with reference to this description, but should instead be determined with reference to the appended claims, along with the full scope of equivalents to which such claims are entitled. The omission in the following claims of any aspect of subject matter that is disclosed herein is not a disclaimer of such subject matter, nor should it be regarded that the inventors did not consider such subject matter to be part of the disclosed inventive subject matter.

Plural elements or steps can be provided by a single integrated element or step. Alternatively, a single element or step might be divided into separate plural elements or steps.

The disclosure of "a" or "one" to describe an element or step is not intended to foreclose additional elements or steps. For example, disclosure of "stem" does not limit the teachings to a single stem. Instead, for example, disclosure of "a stem" may include "one or more motors."

While the terms first, second, third, etc., may be used herein to describe various elements, components, regions, layers and/or sections, these elements, components, regions, layers and/or sections should not be limited by these terms. These terms may be used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below", or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The invention illustratively disclosed herein may suitably be practiced in the absence of any element which is not specifically disclosed herein.

Any of the elements, components, regions, layers and/or sections disclosed herein are not necessarily limited to a single embodiment. Instead, any of the elements, components, regions, layers and/or sections disclosed herein may be substituted, combined, and/or modified with any of the elements, components, regions, layers and/or sections disclosed herein to form one or more embodiments that may be or may not be specifically illustrated or described herein.

The disclosures of all articles and references, including patent applications and publications, testing specifications, are incorporated by reference for all purposes. Other combinations are also possible as will be gleaned from the following claims, which are also hereby incorporated by reference into this written description.

The invention claimed is:

1. A pickleball training apparatus, comprising:

a base;

a substantially vertical stem configured to engage the base; and an arm assembly coupled to the vertical stem, the arm assembly comprising:

a) a first coupler having:

i) a bearing configured to engage the vertical stem;

ii) two or more apertures; and iii) one or more stand offs;

b) two or more arms each having a proximal end configured to engage a respective one of the two or more apertures of the first coupler; and c) a pickleball connected to a distal end of each of the two or more arms;

wherein the two or more apertures of the first coupler extend in a substantially horizontal direction relative to the vertical stem;

wherein the two or more arms are substantially rigid and extend in a substantially horizontal orientation from the first coupler; and wherein the one or more stand offs extend from the first coupler in a generally vertical orientation.

2. The pickleball training apparatus according to claim 1, comprising a second arm assembly configured for coupling to the vertical stem, the second arm assembly comprising:

a) a second coupler having:

i) a second coupler bearing configured to engage the vertical stem;

ii) one or more second coupler apertures; and b) one or more arms each having a proximal end configured to engage the one or more second coupler apertures; and c) a pickle-ball connected to a distal end of each of the one or more arms of the second arm assembly;

wherein the one or more stand offs from the first coupler are configured to contact the second coupler and maintain a vertical spacing between the first coupler and the second coupler.

3. The pickleball training apparatus according to claim 1, wherein the distal end of each of the two or more arms is configured to extend into a central region of a respective pickleball.

4. The pickleball training apparatus according to claim 3, wherein a fastener is configured to engage the distal end of the each of the two or more arms.

5. The pickleball training apparatus according to claim 4, wherein the vertical stem comprises an adjuster to increase or decrease a height of the vertical stem.

6. The pickleball training apparatus according to claim 5, wherein the each of the two or more arms comprises an adjuster to increase or decrease a length of the each of the two or more arms.

7. The pickleball training apparatus according to claim 5, wherein the two or more arms comprises a first arm and a second arm that is connected to the first arm via a coupler, so that the second arm is configured to rotate about an axis that is different than an axis of the first arm and an axis of the vertical stem.

8. The pickleball training apparatus according to claim 7, wherein the vertical stem comprises a stem coupler that separates the vertical stem into a first part and a second part, and the stem coupler is configured to allow the first part to be arranged along an axis that is different than or not aligned with an axis of the second part.

9. The pickleball training apparatus according to claim 8, wherein the apparatus comprises a locking mechanism to lock the arm assembly from spinning about the vertical stem.

10. The pickleball training apparatus according to claim 9, wherein the apparatus comprises a friction adjusting member to increase or decrease friction between the arm assembly and the vertical stem and/or a second arm assembly and the vertical stem.

11. The pickleball training apparatus according to claim 10, wherein the pickleball comprises a sensor that is configured to record data concerning a speed, a velocity, a spin of the pickleball or a combination thereof.

12. The pickleball training apparatus according to claim 11, wherein the apparatus comprise a paddle, and the paddle comprises a sensor that is configured to record data concerning grip strength, grip position, swing speed, swing direction or path, or a combination thereof.

13. The pickleball training apparatus according to claim 12, wherein the data collected by the sensor of the paddle, the sensor of the pickleball, or both is collected and analyzed.

14. The pickleball training apparatus according to claim 13, wherein the data is transferred into a cloud.

15. A pickleball training apparatus, comprising:

a base;

a substantially vertical stem configured to engage the base;

a first arm assembly coupled to the vertical stem, the first arm assembly comprising:

a) a first coupler having:

i) a first coupler bearing configured to engage the vertical stem;

ii) one or more first coupler apertures; and iii) one or more stand offs;

b) one or more arms each having a proximal end configured to engage a respective one of the one or more apertures of the first coupler; and c) a pickleball connected to a distal end of each of the one or more arms;

a second arm assembly coupled to the vertical stem, the second arm assembly comprising a) a second coupler having:

i) a second coupler bearing configured to engage the vertical stem; and ii) one or more second coupler apertures;

b) one or more additional arms each having a proximal end configured to engage the one or more apertures of the second coupler; and c) an additional pickleball connected to a distal end of each of the one or more additional arms;

wherein the one or more arms, the one or more additional arms, or both are substantially rigid and extend in a substantially horizontal orientation from the first coupler, the second coupler, or both and the substantially vertical stem;

wherein the one or more stand offs extend from the first coupler in a generally vertical orientation; and wherein the one or more stand offs from the first coupler are configured to contact the second coupler and maintain a vertical spacing between the first coupler and the second coupler.

* * * * *